US007125226B2

(12) United States Patent
Horng et al.

(10) Patent No.: US 7,125,226 B2
(45) Date of Patent: Oct. 24, 2006

(54) IMPELLER FOR RADIAL-FLOW HEAT DISSIPATING FAN

(75) Inventors: Alex Horng, Kaohsiung (TW); Yu-Yuan Lu, Kaohsiung (TW); Mei-Chih Fang, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 152 days.

(21) Appl. No.: 10/900,116

(22) Filed: Jul. 28, 2004

(65) Prior Publication Data

US 2005/0287003 A1 Dec. 29, 2005

(51) Int. Cl.
*B63H 1/26* (2006.01)

(52) U.S. Cl. ..... 416/203; 416/228; 416/234; 416/223 B

(58) Field of Classification Search ..... 416/228, 416/234, 223 B, 186 R, 203, 187
See application file for complete search history.

(56) References Cited

U.S. PATENT DOCUMENTS 3,846,043 A * 11/1974 Wolbrink et al. ..... 416/183
6,558,120 B1 * 5/2003 Kim et al. ..... 416/186 R
6,877,954 B1 * 4/2005 Lin et al. ..... 416/175

* cited by examiner

*Primary Examiner*—Ninh H. Nguyen
(74) *Attorney, Agent, or Firm*—Bacon & Thomas, PLLC

(57) ABSTRACT

An impeller for a radial-flow heat dissipating fan includes a hub and a plurality of blades surrounding the hub. The blades are connected to a circumference of the hub to allow joint rotation of the hub and the blades. More than one blade include an air inlet side edge and an air outlet side edge. The air inlet side edge of each of the more than one blade has a radial length smaller than that of the air out side edge, thereby increasing an air inlet amount and smoothly changing incoming axial airflow into centrifugal airflow.

26 Claims, 7 Drawing Sheets

IMPELLER FOR RADIAL-FLOW HEAT DISSIPATING FAN

BACKGROUND OF THE INVENTION

1. Field of the Invention

The present invention relates to an impeller for a radial-flow heat dissipating fan. In particular, the present invention relates to an impeller for a radial-flow heat dissipating fan with increased air inlet amount.

2. Description of Related Art

FIG. 1 of the drawings illustrates a conventional radial-flow heat dissipating fan. The radial-flow heat dissipating fan in FIG. 1 comprises a casing 1 and a cover 2. The casing 1 includes a compartment 11 and a side outlet 12. The cover 2 is mounted to the casing 1 and includes an inlet 21. An impeller 3 is rotatably mounted in the compartment 11 of the casing 1 and includes a hub 31, a supporting member 32 extending from the hub 31, and a plurality of blades 33 each having an edge mounted on a side of the supporting member 32.

FIG. 2 illustrates another conventional radial-flow heat dissipating fan, wherein a connecting ring 34 extends across the other edges of the blades 33 to improve the strength. In operation, turning of the blades 33 of the impeller 3 drives axial airflow into the casing 1 via the inlet 21 of the cover 2. Then, the axial airflow is driven by the blades 33 to exit the casing 1 via the side outlet 12 for dissipating an object such as a fin.

Although the above radial-flow heat dissipating fans are widely used in computers, there are still several problems. First, the other edge 33*a* of each blade 33 is located at the same level as a top face of the hub 31. After assembly, the top face of the hub 31 is very close to the inlet 21 of the cover 2. Thus, the incoming air can only pass through the inlet 21 via the gap between the blades 33, resulting in limitation to the amount of the incoming axial airflow. In this case, if the other edge 33*a* of each blade 33 has a relatively long radial length, the other edge 33*a* interferes with entrance of the incoming axial airflow via the inlet 21. The air inlet amount could not be increased, the air outlet amount and the wind pressure are reduced. Secondly, if the other edge 33*a* of each blade 33 has a relatively long radial length, the incoming axial airflow entering the casing 1 via the inlet 21 is directly guided by the rotation of the edge 33*a* and thus turns into centrifugal airflow, leading to blowing noise and adversely affect to the rotational efficiency of the impeller.

OBJECTS OF THE INVENTION

An object of the present invention is to provide an impeller for a radial-flow heat dissipating fan for increasing air inlet amount and air outlet amount.

Another object of the present invention is to provide an impeller for a radial-flow heat dissipating fan for increasing outlet wind pressure.

A further object of the present invention is to provide an impeller for a radial-flow heat dissipating fan for lowering blowing noise.

SUMMARY OF THE INVENTION

In accordance with an aspect of the present invention, an impeller for a radial-flow heat dissipating fan comprises a hub, a plurality of blades surrounding the hub, and means for connecting the blades to a circumference of the hub, allowing joint rotation of the hub and the blades.

More than one blade include an air inlet side edge and an air outlet side edge. The air inlet side edge of each of the more than one blade has a radial length smaller than that of the air out side edge, thereby increasing an air inlet amount and smoothly changing incoming axial airflow into centrifugal airflow.

In an embodiment, the inner edge of each blade includes a first section and a second section having a slope or curvature different from that of the first section. In another embodiment, the inner edge of each blade includes a shoulder.

In an embodiment, each blade includes an axial length greater than that of the hub, defining a buffering space between a top of the hub and the inner edges of the blade for increasing an air inlet area and for assisting in change of the axial incoming airflow into the centrifugal airflow.

In another embodiment, the impeller includes a first set of blades and a second set of blades that are alternately disposed. Each of the first set of blades has a rectilinear inner edge such that the air inlet side edge of each of the first set of blades has a radial length the same as that of the air outlet side edge of each of the first set of blades. The air inlet side edge of each of the second set of blades has a radial length smaller than that of the air outlet side edge of each of the second set of blades.

In an embodiment, a connecting ring extends across the air inlet side edge of each blade and another connecting ring extends across the air outlet side edge of each blade. At least one of the blades is connected by a supporting member to the circumference of the hub.

In a further embodiment, an annular plate extends from the circumference of the hub, and the blades are mounted on a side of the annular plate.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
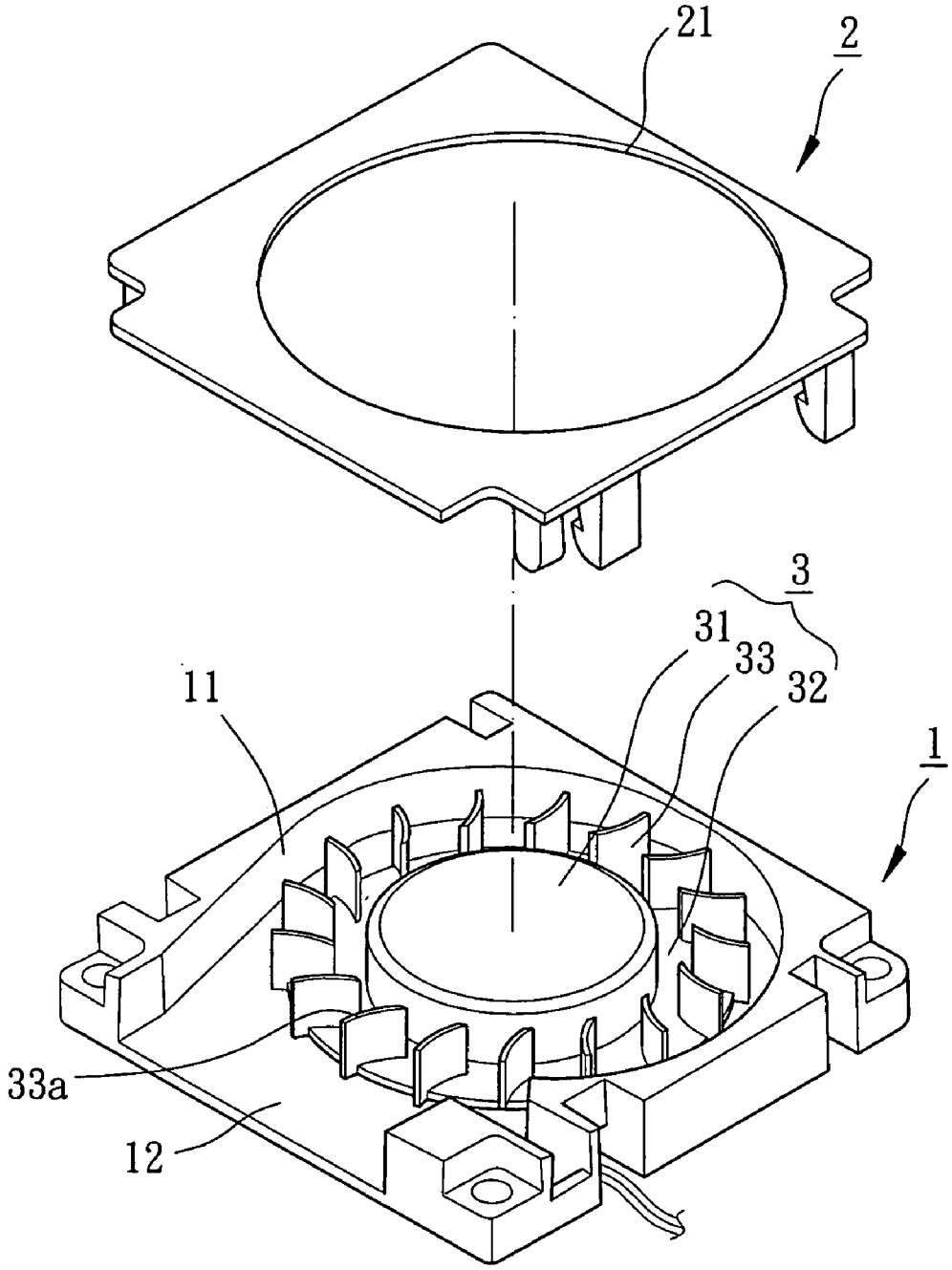
FIG. 1 PRIOR ART
FIG. 1 is an exploded perspective view of a conventional radial-flow heat dissipating fan.
Figure 2:
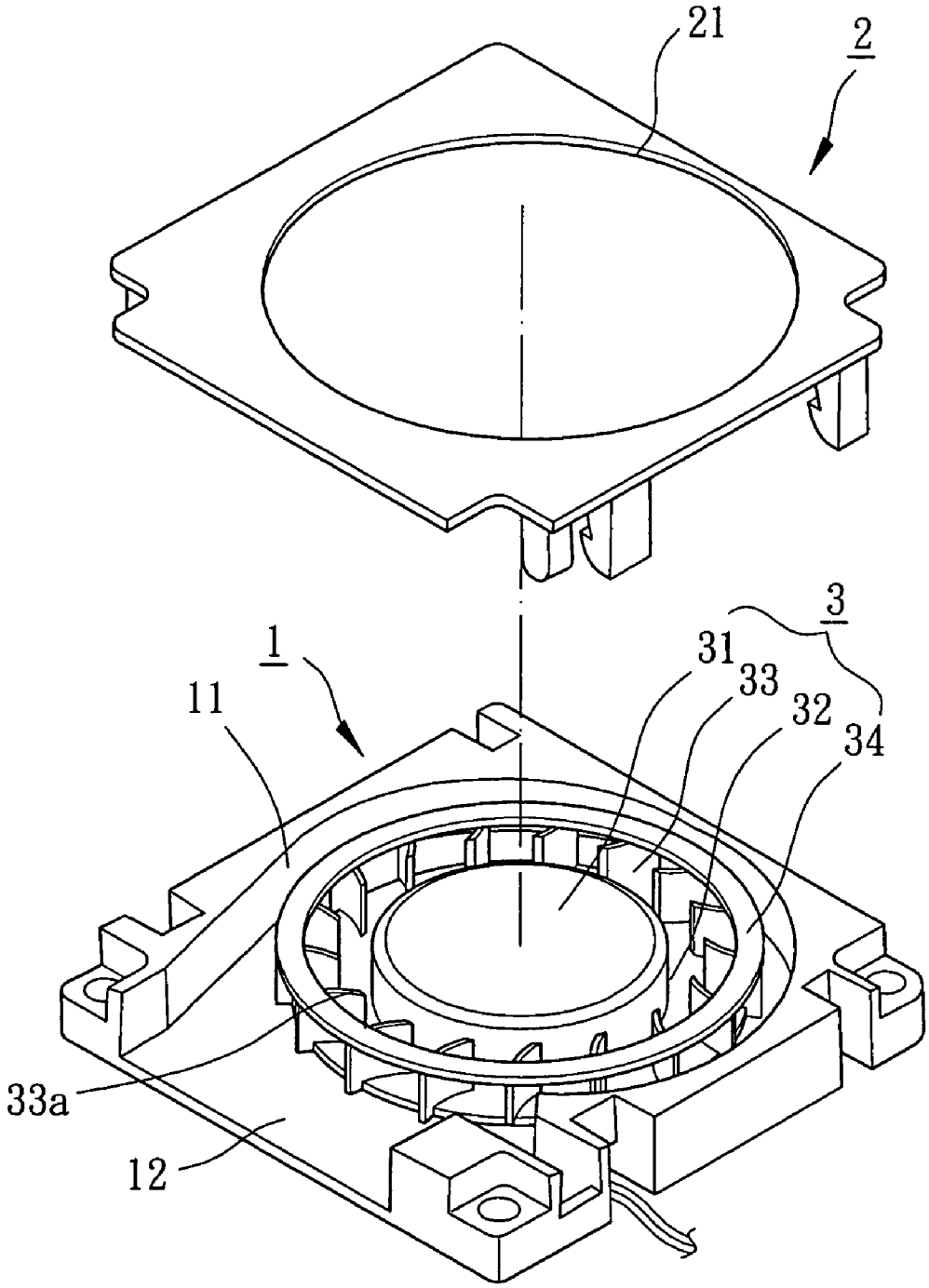
FIG. 2 PRIOR ART
FIG. 2 is an exploded perspective view of another conventional radial-flow heat dissipating fan.
Figure 3:
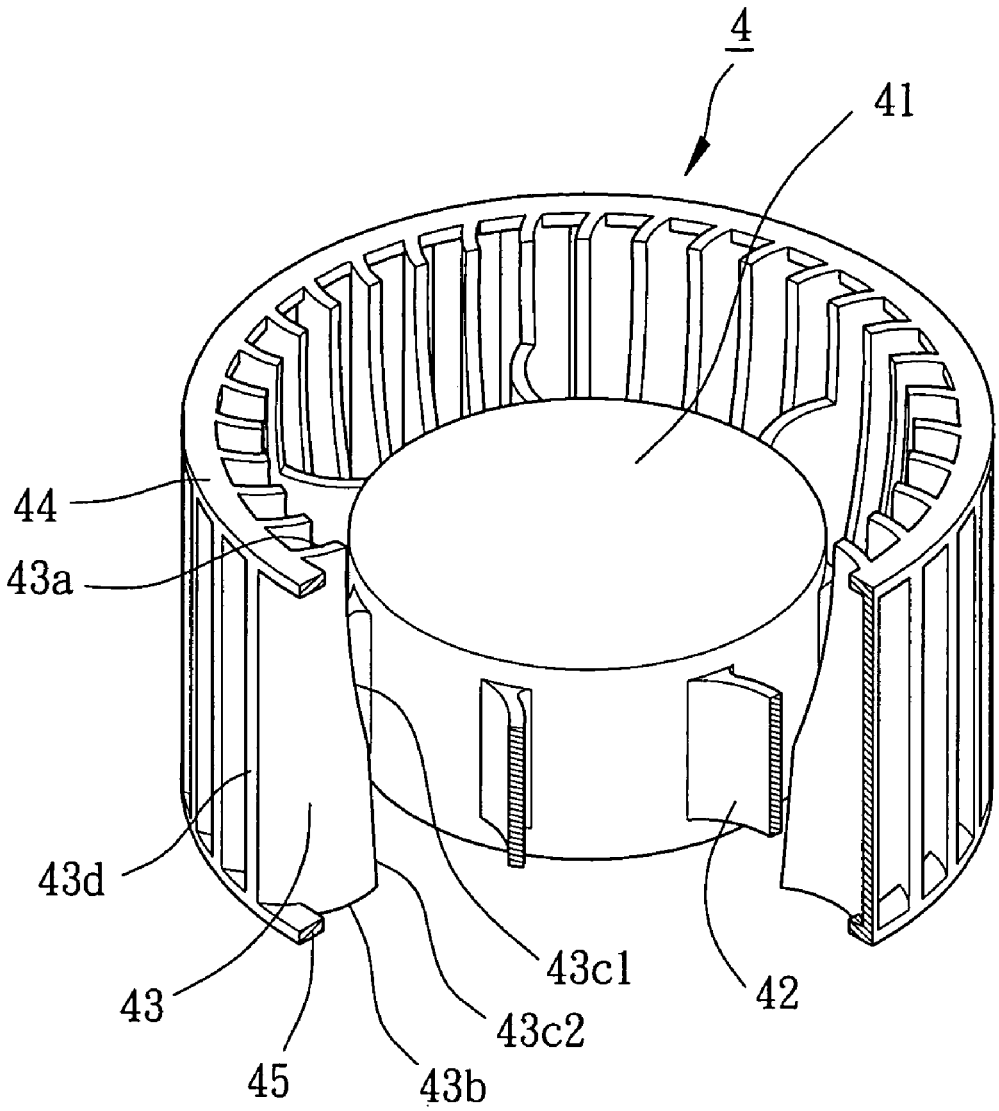
FIG. 3 is a perspective view, partly cutaway, of a first embodiment of an impeller for a radial-flow heat dissipating fan in accordance with the present invention.
Figure 4:
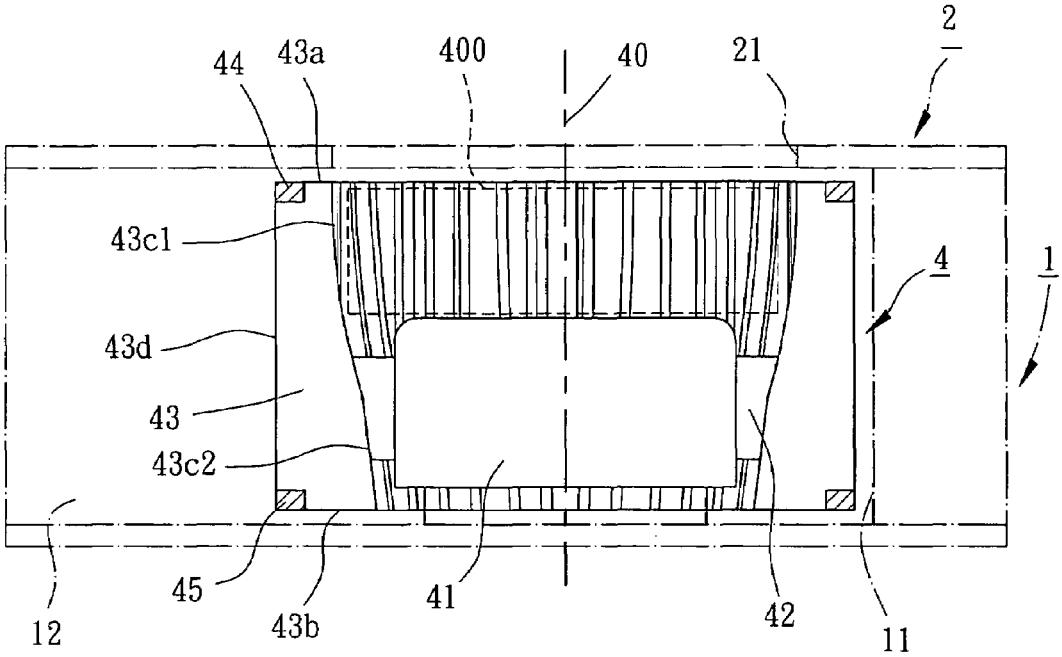
FIG. 4 is a side view of the impeller in FIG. 3.

Referring to FIGS. 3 and 4, a first embodiment of an impeller 4 in accordance with the present invention comprises a hub 41, at least one supporting member 42, a plurality of blades 43, and at least one connecting ring 44, 45. The impeller 4 may be coupled with a motor (not shown) and assembled with a casing 1 and a cover 2 (see FIGS. 1 and 2) to form a complete radial-flow heat dissipating fan. The motor is mounted inside the hub 41 that is rotatably mounted in a compartment 11 in the casing 11. In this embodiment, a plurality of supporting members 42 are provided, with each supporting member 42 being connected between a circumference of the hub 41 and an associated one of the blades 43. Preferably, each supporting member 42 is a wave-like rib extending from the circumference of the hub 41 to the associated blade 43. A first connecting ring 44 extends across an air inlet side edge 43*a* of each blade 43, and a second connecting ring 45 extends across an air outlet side edge 43*b* of each blade 43, providing a structure with improved strength.

Still referring to FIGS. 3 and 4, each blade 43 further includes an inner edge facing the hub 41 and an outer edge 43*d* facing away from the hub 41. The inner edge of each blade 43 includes at least one section. In this embodiment, the inner edge of each blade 43 includes a first section 43*c*1 adjacent to the air inlet side and a second section 43*c*2 adjacent to the air outlet side. The inner edges of some of the blades 43 are connected to the supporting members 42. The first section 43*c*1 and the second section 43*c*2 have different slopes or different curvatures such that a radial length of the air inlet side edge 43*a* of each blade 43 is smaller than that of the air outlet side edge 43*b* of each blade 43, thereby avoiding interference to drawing of the air into the casing 1 via the inlet 21. Further, the outer edge 43*a* of each blade 43 is parallel to a rotational axis 40 of the impeller 43 without any change in the radial length. Further, an axial level of the impeller 43 is preferably above the hub 41 such that a buffering space 400 is defined between a top face of the hub 41 and the first sections 43*c*1 of the inner edges of the blades 43. The air inlet area is increased, and airflow can be smoothly changed from the axial direction to the centrifugal direction.

Figure 5:
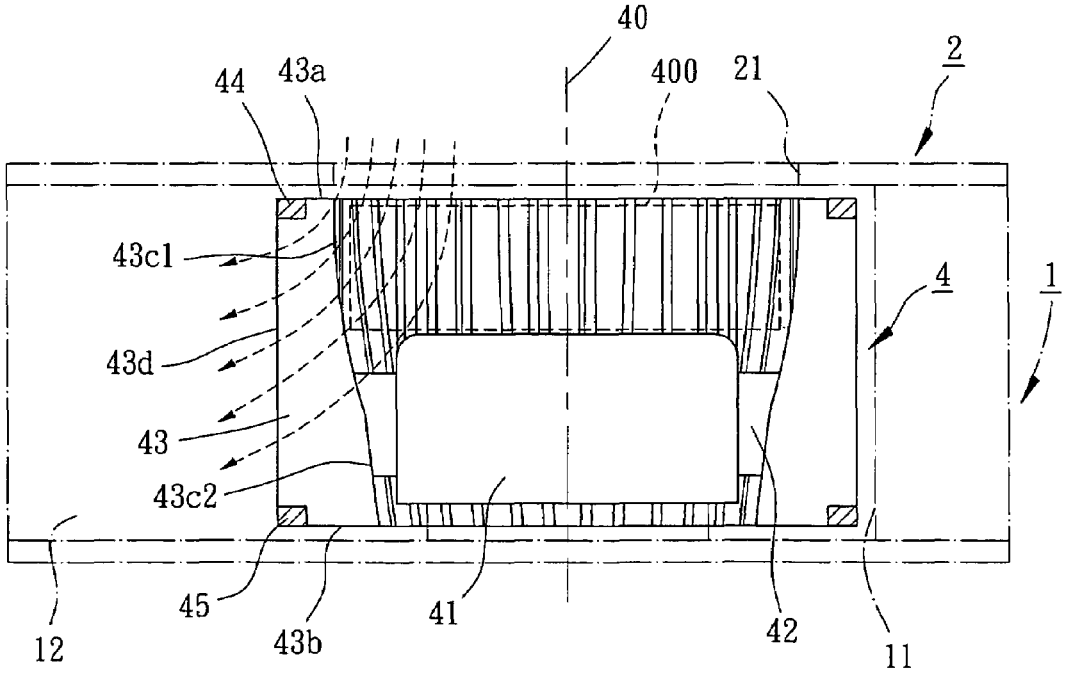
FIG. 5 is a view similar to FIG. 4, illustrating operation of the impeller.

Referring to FIG. 5, when the blades 43 of the impeller 4 turns, axial airflow is drawn into the buffering space 400 via the inlet 21 of the cover 2. Since the first section 43*c*1 of the inner edge of each blade 43 is slanted or curved, the air inlet side edge 43*a* of each blade 43 has a relatively smaller radial length. Thus, the buffering space 400 can be enlarged to the maximum. When the axial airflow enters the buffering space 400, the buffering space 400 provides a sufficient space for changing the axial airflow into centrifugal airflow. Thus, pressurized centrifugal airflow is obtained and exits the casing 1 via the outlet 12. The slopes or curvatures of the first and second sections 43*c*1 and 43*c*2 of the inner edges of the blades 43 provide the lower portions of the blades 43 with a greater air driving power such that air flows easily in the lower portions of the blades 43. Namely, the directional change from the axial direction to the centrifugal direction is not completely carried out at the upper portions of the blades 43, which lowers the blowing noise of the blades 43.

Figure 6:
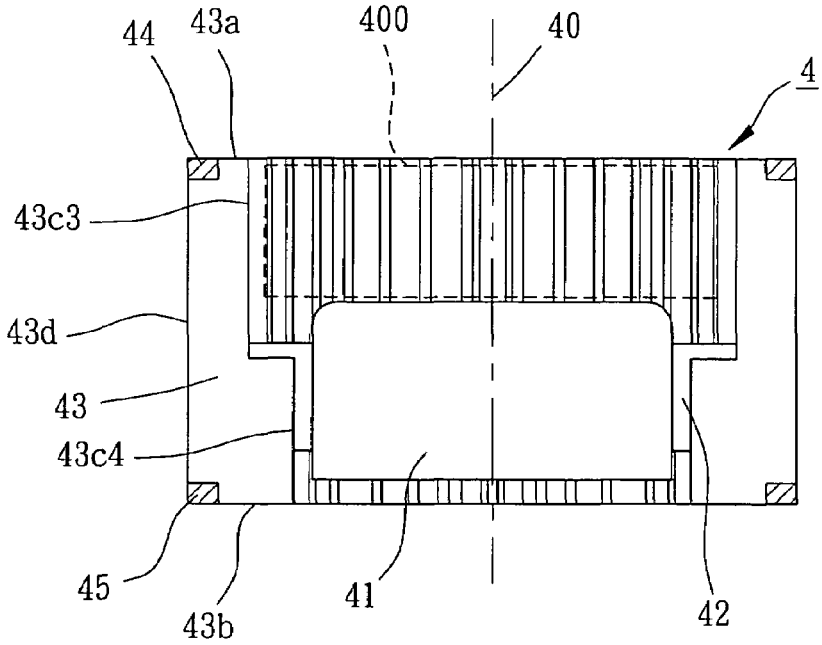
FIG. 6 is a side view illustrating a second embodiment of the impeller in accordance with the present invention.

FIG. 6 illustrates a second embodiment of the invention, wherein the first section 43*c*3 and the second section 43*c*4 of the inner edge of each blade 43 are rectilinear to form a shoulder. This embodiment provides advantages the same as those of the first embodiment.

Figure 7:
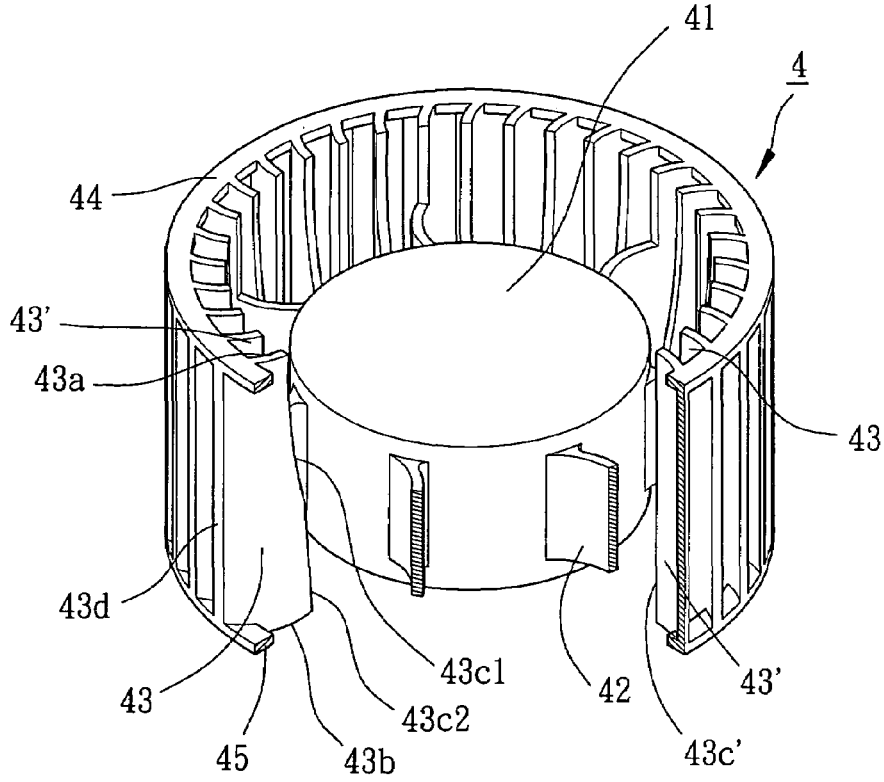
FIG. 7 is a perspective view, partly cutaway, of a third embodiment of the impeller in accordance with the present invention.
Figure 8:
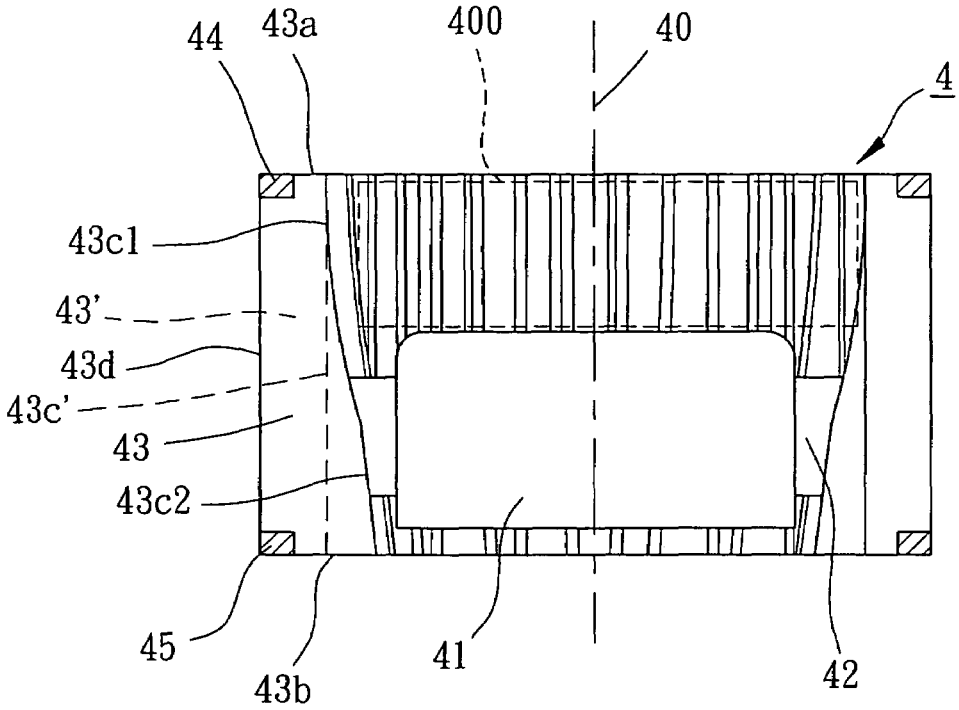
FIG. 8 is a side view of the impeller in FIG. 7.

FIGS. 7 and 8 illustrate a third embodiment of the invention, wherein the impeller 4 comprises two sets of alternately disposed blades 43 and 43' having different shapes. Each of a first set of blades 43 has a structure the same as that in the first embodiment. Each of a second set of blades 43' has a rectilinear inner edge 43*c*' throughout an axial length of the blade 43'. In other words, the inlet side edge of each of the second set of blades 43' has a radial length the same as that of the outlet side edge of each of the second set of blades 43'. Drawing of air into the casing 1 via the inlet 21 of the cover 2 is not interfered. Further, a buffering space 400 is defined between the inner edges 43*c*1 of the blades 43, the inner edges 43*c*' of the blades 43', and a top face of the hub 41. Similar to the first embodiment, the air inlet area is increased, the airflow can be smoothly changed from the axial direction to the centrifugal direction, and the blowing noise is lowered.

Figure 9:
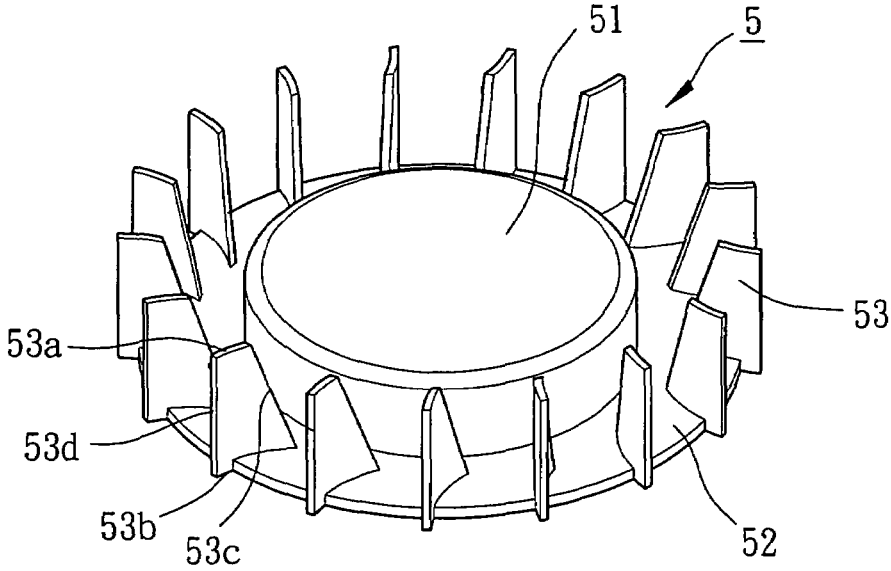
FIG. 9 is a perspective view of a fourth embodiment of the impeller in accordance with the present invention.
Figure 10:
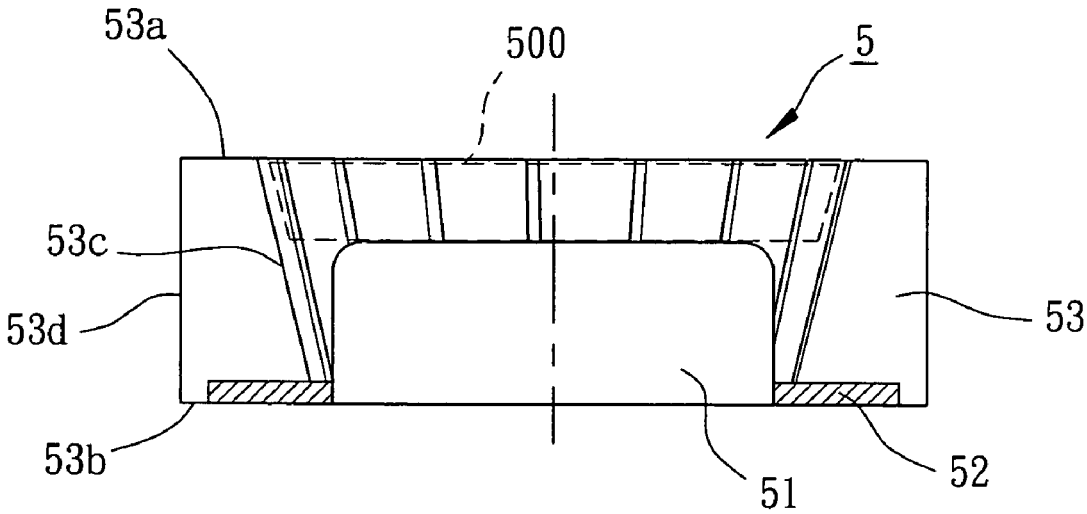
FIG. 10 is side view of the impeller in FIG. 9.

FIGS. 9 and 10 illustrate a fourth embodiment of the invention, in this embodiment, the impeller 5 includes a hub 51, a plate-like supporting member 52 extending radially outward from a circumference of the hub 51, and a plurality of blades 53 provided on a side of the supporting member 52. Each blade 53 includes an inner edge 53*c*, a rectilinear outer edge 53*d*, an air inlet side edge 53*a*, and an air outlet side edge 53*b*. The inner edge 53*c* is slanted. Alternatively, the inner edge 53*c* may include two sections similar to the first embodiment. The air outlet side edge 53*b* has a radial length longer than that of the air inlet side edge 53*a*. Thus, drawing of air into the casing 1 via the inlet 21 of the cover 2 is not interfered. The axial height of each blade 43 is greater than that of the hub 51. Thus, a buffering space 500 is defined between the inner edges 53*c* of the blades 53 and a top face of the hub 51. Similar to the first embodiment, the air inlet area is increased, the airflow can be smoothly changed from the axial direction to the centrifugal direction, and the blowing noise is lowered.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. An impeller for a radial-flow heat dissipating fan, comprising:

a hub having a circumference;

a plurality of blades surrounding the hub; and at least one supporting member connecting at least one of the blades to the circumference of the hub; and, wherein the impeller includes a first set of said blades and a second set of said blades that are alternately disposed, each of said second set of blades having a rectilinear inner edge, the air inlet side edge of each of the second set of blades having a radial length the same as that of the air outlet side edge of each of the second set of blades, the air inlet side edge of each of the first set of blades having a radial length smaller than that of the air outlet side edge of each of the second set of blades, thereby increasing an air inlet amount and smoothly changing incoming axial airflow into centrifugal flow.

2. The impeller as claimed in claim 1, wherein an inner edge of at least one of the first set of blades includes a first section and a second section having a slope different from that of the first section.

3. The impeller as claimed in claim 1, wherein an inner edge of at least one of the first set of blades includes a first section and a second section having a curvature different from that of the second section.

4. The impeller as claimed in claim 1, wherein the inner edge of each of said first set of blades forms a shoulder.

5. The impeller as claimed in claim 1, wherein at least one of said blades includes an axial length greater than that of the hub, defining a buffering space between a top of the hub and the inner edges of said at least one of the blades.

6. The impeller as claimed in claim 1, further comprising a connecting ring extending across the air inlet side edge of each said blade.

7. The impeller as claimed in claim 6, further comprising another connecting ring extending across the air outlet side edge of each side blade.

8. The impeller as claimed in claim 1, further comprising a connecting ring extending across the air outlet side edge of each said blade.

9. The impeller as claimed in claim 1, further comprising at least one connecting ring extending across each said blade.

10. The impeller as claimed in claim 9, further including at least one supporting member connected between the circumference of the hub and at least one of the blades.

11. The impeller as claimed in claim 1, wherein the impeller includes an annular plate extending from the circumference of the hub, and wherein said blades are mounted on a side of the annular plate.

12. The impeller as claimed in claim 1, wherein the supporting member is a curved rib.

13. An impeller for a radial-flow heat dissipating fan, comprising:

a hub having a circumference;

a plurality of blades surrounding the hub; and at least one supporting member connecting at least one of the blades to the circumference of the hub;

wherein said at least one of the blades includes an air inlet side edge and an air outlet side edge, the air inlet side edge having a radial length smaller than that of the air outlet side edge;

and wherein an inner edge of said at least one of the blades includes a first section and a second section that are rectilinear to form a shoulder.

14. The impeller as claimed in claim 13, wherein sections of the inner edge have different slopes or curvatures.

15. The impeller as claimed in claim 13, wherein said at least one of the blades includes an axial length greater than that of the hub, defining a buffering space between a top of the hub and the inner edge of said at least one of the blades.

16. The impeller as claimed in claim 13, further comprising a connecting ring extending across the air inlet side edge or the air outlet side edge of said at least one of the blades.

17. The impeller as claimed in claim 13, wherein the supporting member is a curved rib.

18. An impeller for a radial-flow heat dissipating fan, comprising:

a hub having a circumference;

a plurality of blades surrounding the hub;

at least one supporting member connecting the blade to the circumference of the hub; and at least one connecting ring extending across the blade;

wherein at least one of the blades includes an air inlet side edge and an air outlet side edge, the air inlet side edge having a radial length smaller than that of the air outlet side edge.

19. The impeller as claimed in claim 18, wherein an inner edge of the blade includes a first section and a second section having a slope or a curvature different from that of the first section.

20. The impeller as claimed in claim 18, wherein said at least one of the blades includes an axial length greater than that of the hub, defining a buffering space between a top of the hub and the inner edges of said at least one of the blades.

21. The impeller as claimed in claim 18, further comprising a connecting ring extending across the air inlet side edge or the air outlet side edge of the at least one of the blades.

22. The impeller as claimed in claim 18, wherein the supporting member is a curved rib.

23. An impeller for a radial-flow heat dissipating fan, comprising:

a hub having a circumference;

a plurality of blades surrounding the hub; and at least one plate-like supporting member extending from the circumference of the hub, aid blades being mounted on a dies of the plate-like supporting member;

wherein at least one of the blades includes an air inlet side edge and an air outlet side edge, the air inlet side edge having a radial length smaller than that of the air outlet side edge.

24. The impeller as claimed in claim 23, wherein an inner edge of the blade includes a first section and a second section having a slope or a curvature different from that of the first section.

25. The impeller as claimed in claim 23, wherein said at least one of the blades includes an axial length greater than that of the hub, defining a buffering space between a top of the hub and the inner edges of said at least one of the blades.

26. The impeller as claimed in claim 23, further comprising a connecting ring extending across the air inlet side edge or the air outlet side edge of the at least one of the blades.

* * * * *